US009696660B1

(12) United States Patent
Chuang et al.

(10) Patent No.: US 9,696,660 B1
(45) Date of Patent: Jul. 4, 2017

(54) TONER CARTRIDGE FOR AN ELECTRONIC IMAGING DEVICE

(71) Applicant: GENERAL PLASTIC INDUSTRIAL CO., LTD., Taichung (TW)

(72) Inventors: Chin-His Chuang, Lugang Township, Changhua County (TW); Zheng-Yi Xiao, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 15/213,713

(22) Filed: Jul. 19, 2016

(30) Foreign Application Priority Data

Dec. 16, 2015 (CN) ..... 2015 2 1052458 U

(51) Int. Cl.
*G03G 15/08* (2006.01)

(52) U.S. Cl.
CPC ..... *G03G 15/0891* (2013.01); *G03G 15/0865* (2013.01)

(58) Field of Classification Search
CPC ..... G03G 15/0891; G03G 15/0865; G03G 15/0867
USPC ..... 399/258, 262, 263
See application file for complete search history.

(56) References Cited

U.S. PATENT DOCUMENTS 7,729,644 B2 * 6/2010 Thornton et al. .... G03G 15/087 399/262
8,050,597 B2 * 11/2011 Yoshizawa et al. ..... G03G 15/0898 399/258
8,862,036 B2 * 10/2014 Maeshima ..... G03G 15/0872 399/262
8,965,250 B2 * 2/2015 Komatsu et al. .. G03G 15/0839 399/262
8,989,636 B2 * 3/2015 Hori et al. ..... G03G 15/0881 399/262

* cited by examiner

*Primary Examiner* — William J Royer
(74) *Attorney, Agent, or Firm* — Muncy, Geissler, Olds & Lowe, P.C.

(57) ABSTRACT

A toner cartridge includes a cylinder having an opening and accommodating carbon powder, a transmission member having a pipe portion sleeved onto the cylinder, an end portion and at least one outlet communicating with the opening, a powder guiding member having a main body disposed at the end portion and blades extended from the main body radially, and a powder storing cover having a cover body sleeved onto the pipe portion and a powder exit located under the powder guiding member. As a result, the carbon powder can leave the cylinder through the opening, enter the powder storing cover through the outlet, and be driven by the rotation of each blade of the powder guiding member to move to the powder exit, thereby discharged for usage in an electronic imaging device. The toner cartridge is simple in structure, convenient and fast in assembly, and less possibly has false actions.

17 Claims, 10 Drawing Sheets

TONER CARTRIDGE FOR AN ELECTRONIC IMAGING DEVICE

BACKGROUND OF THE INVENTION

1. Field of the Invention

The present invention relates to electronic imaging devices and more particularly, to a toner cartridge for an electronic imaging device.

2. Description of the Related Art

In an electronic imaging device such as a copy machine, a printer or a fax machine, one of the most important components is the toner cartridge, which is the technical core of the development of the electronic imaging device. At present, there are various designs for toner cartridge in the industry, wherein some designs are primarily for the purpose of enabling the toner cartridge to discharge the carbon powder therein as completely as possible, which is taken as the most important consideration in the structural design of these toner cartridges. However, to achieve the aforesaid purpose, some toner cartridges are very complicated in structure and need a collocation or combination of multiple elements to discharge the carbon powder completely. In such condition, the assembly of the toner cartridge consumes relatively more time, and false actions such as the elements being locked by each other are liable to happen in practical operation of the toner cartridge, disabling the toner cartridge from discharging carbon powder successfully.

SUMMARY OF THE INVENTION

The present invention has been accomplished in view of the above-noted circumstances. It is an objective of the present invention to provide a toner cartridge which is simple in structure, convenient and fast in assembly, and can prevent the occurrence of false action.

To attain the above objective, the present invention provides a toner cartridge which includes a cylinder, a transmission member, a powder guiding member and a powder storing cover. The cylinder has an opening communicating with interior and exterior of the cylinder. The transmission member has a pipe portion sleeved onto the cylinder, a gear ring provided on a periphery of the pipe portion, an end portion provided at a free end of the pipe portion, and at least one outlet provided at the end portion and communicating with the opening. The powder guiding member has a main body fixed to the end portion of the transmission member, and a plurality of blades extended from the main body radially. The powder storing cover has a cover body sleeved onto the pipe portion of the transmission member to close the outlet, and a powder exit located under the powder guiding member.

Compared with the conventional technology, the toner cartridge of the present invention is simpler in structure, thereby convenient and fast in assembly and less possible to have false actions such as the elements in the toner cartridge being locked by each other to disable the toner cartridge to discharge carbon powder successfully.

DETAILED DESCRIPTION OF THE INVENTION

Figure 1:
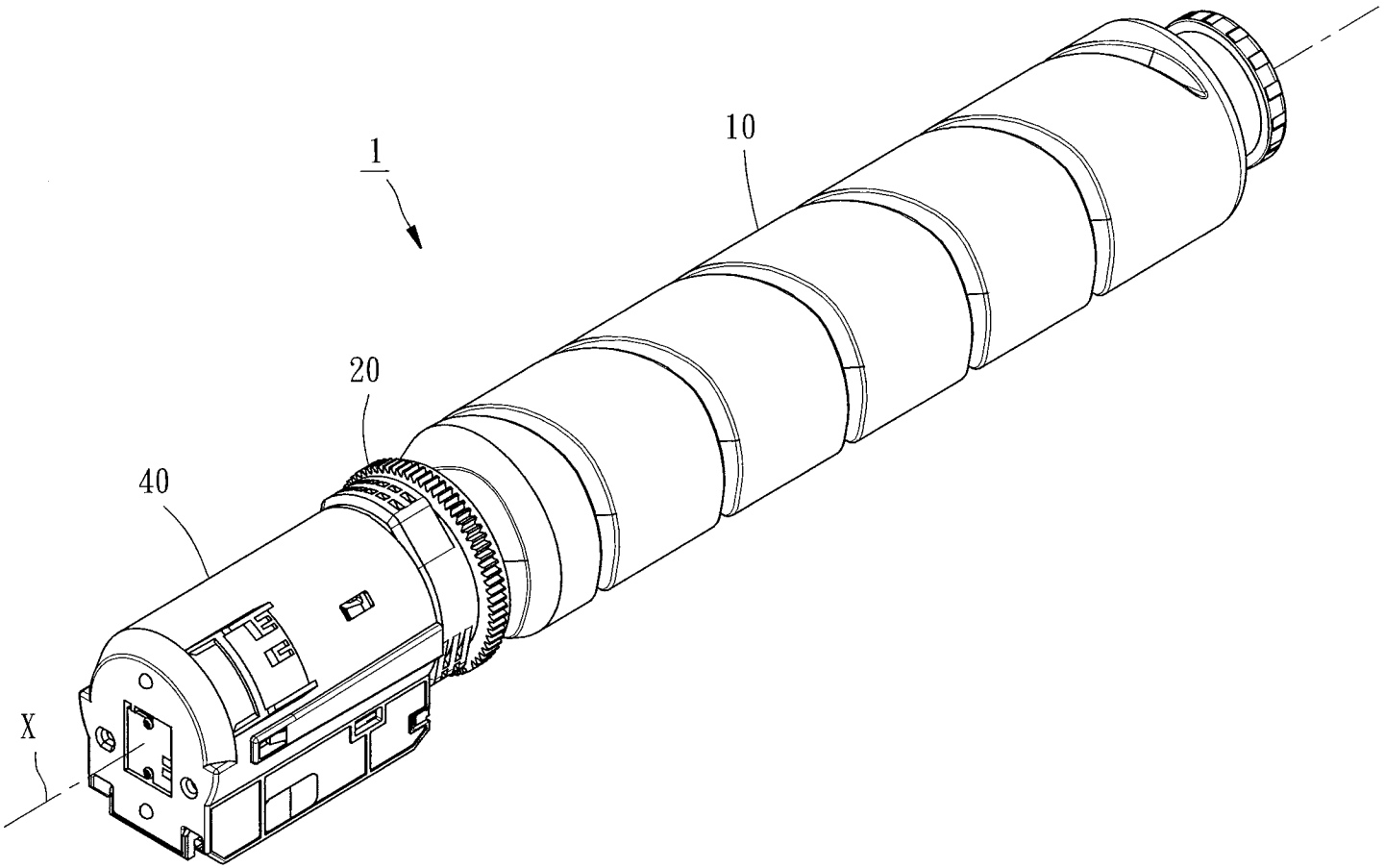
FIG. 1 is an assembled perspective view of a toner cartridge according to a first preferred embodiment of the present invention.
Figure 2:
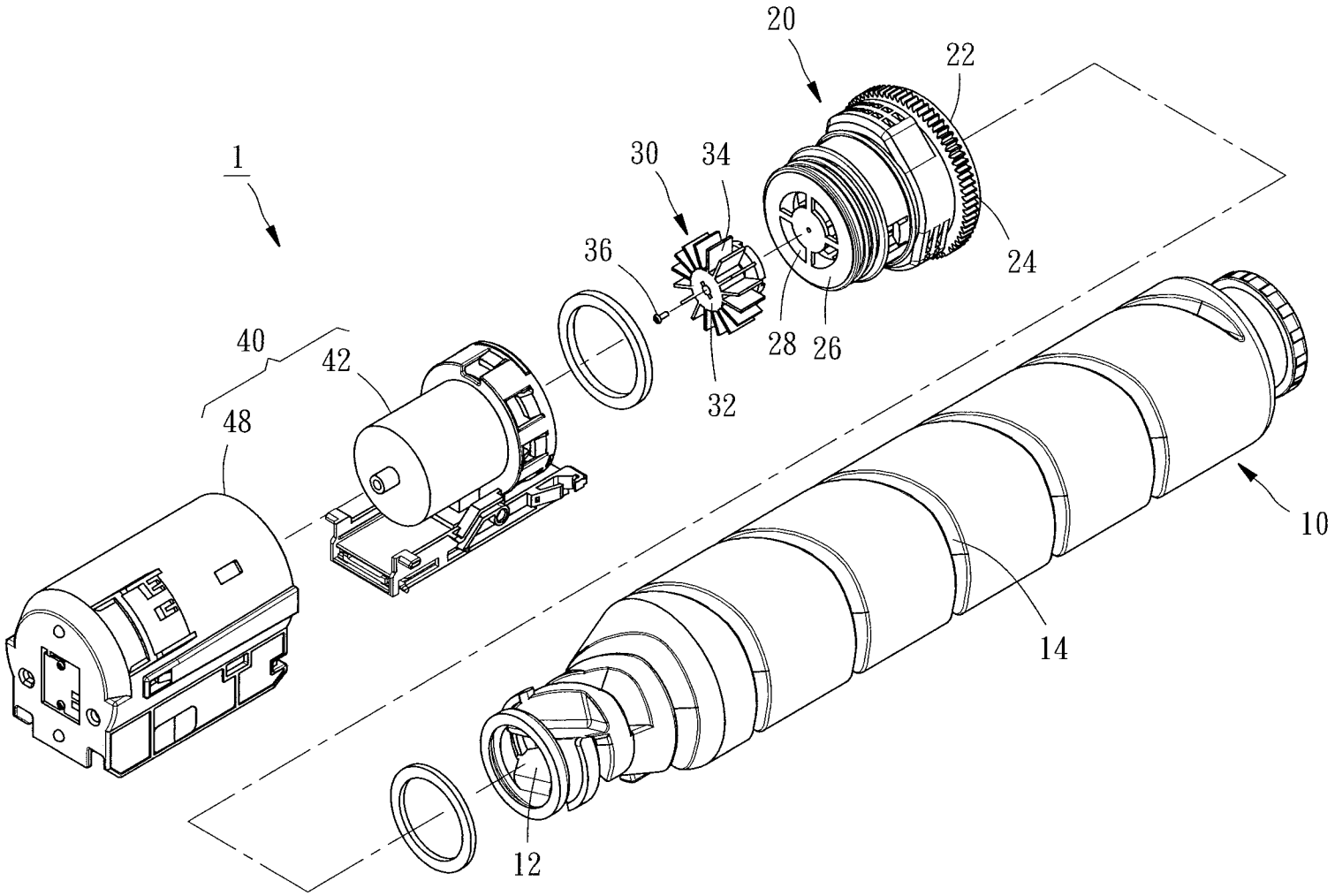
FIG. 2 is an exploded perspective view of the toner cartridge according to the first preferred embodiment of the present invention.

Referring to FIGS. 1-2, a toner cartridge 1 according to a first preferred embodiment of the present invention includes a cylinder 10, a transmission member 20, a powder guiding member 30 and a powder storing cover 40. The toner cartridge 1 is adapted to be disposed in an electronic imaging device (not shown).

The cylinder 10 has an opening 12 communicating with interior and exterior of the cylinder 10, and a thread 14. The aforesaid interior refers to the internal space of the cylinder 10 itself. The aforesaid exterior refers to the space outside of the cylinder 10. The internal space of the cylinder 10 is adapted for accommodating carbon powder. The thread 14 is concaved from a part of the external surface of the cylinder 10 to the internal space of the cylinder 10. The opening 12 is provided for the carbon powder to pass through.

The transmission member 20 has a pipe portion 22 sleeved onto the cylinder 10, a gear ring 24 provided on the periphery of the pipe portion 22, an end portion 26 provided at a free end of the pipe portion 22, and four outlets 28 provided at the end portion 26 for the carbon powder to pass through. The outlets 28 are located adjacent to the opening 12 of the cylinder 10 so that the outlets 28 communicate with the opening 12 and the internal space of the cylinder 10. The gear ring 24 is adapted for being engaged with a driving gear (not shown) of the electronic imaging device. The transmission member 20 can be driven to rotate in a way that the gear ring 24 is rotated by the driving gear. The cylinder 10 and the transmission member 20 are fixed to each other and capable of rotating together. In other embodiments, the amount of the outlet 28 can be modified according to demands, and the transmission member 20 may be rotatable relative to, not fixed to, the cylinder 10.

Figure 3:
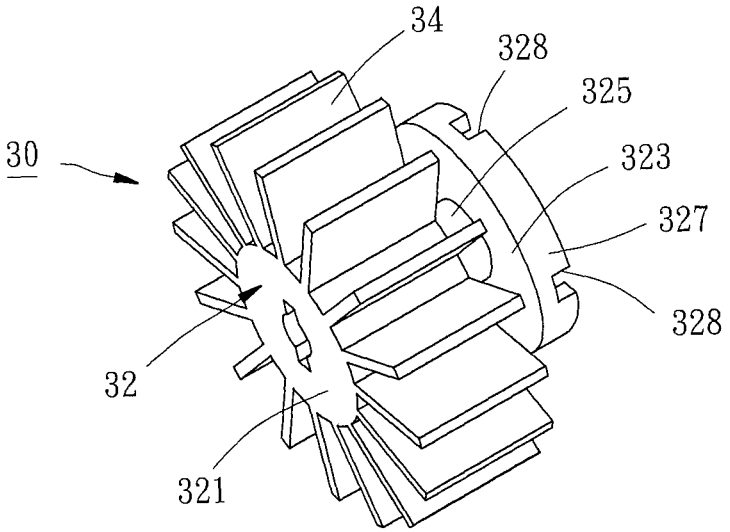
FIG. 3 is a perspective view of a powder guiding member according to the first preferred embodiment of the present invention.
Figure 4:
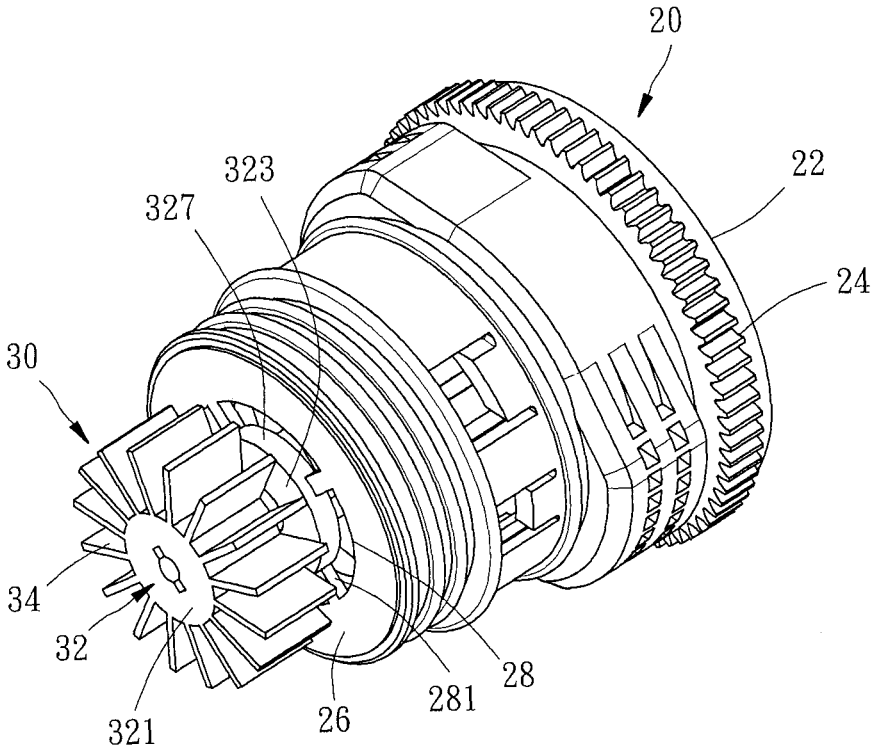
FIG. 4 is a perspective view of the powder guiding member and a transmission member according to the first preferred embodiment of the present invention.

Referring to FIGS. 3-4, the powder guiding member 30 has a main body 32 disposed at the end portion 26 of the transmission member 20, and a plurality of blades 34 extended from the main body 32 radially. In this embodiment, the main body 32 is fixed to the center of the end portion 26 of the transmission member 20 by means of a screw 36. The main body 32 has an axle portion 321, a plate base 323 abutted on the end portion 26 of the transmission member 20, and a rod portion 325 connected between the axle portion 321 and the plate base 323. The blades 34 are extended from the axle portion 321. The plate base 323 has four clutch portions 327 inserted in the four outlets 28 of the transmission member 20 respectively, wherein two lateral surfaces 328 of each of the clutch portions 327 are abutted on an inner border 281 of the associated outlet 28, so that the powder guiding member 30 is combined with the transmission member 20 relatively more firmly and prevented from rotation relative to the transmission member 20. Besides, in this embodiment, the blades 34 are shaped as flat plates, and each of the blades 34 is parallel to an axial direction X of the main body 32 of the powder guiding member 30. Because of being connected with the transmission member 20, the powder guiding member 30 can rotate along with the transmission member 20 and the cylinder 10. In other embodiments, the clutch portions 327 and the blades 34 can be modified in amount.

Figure 5:
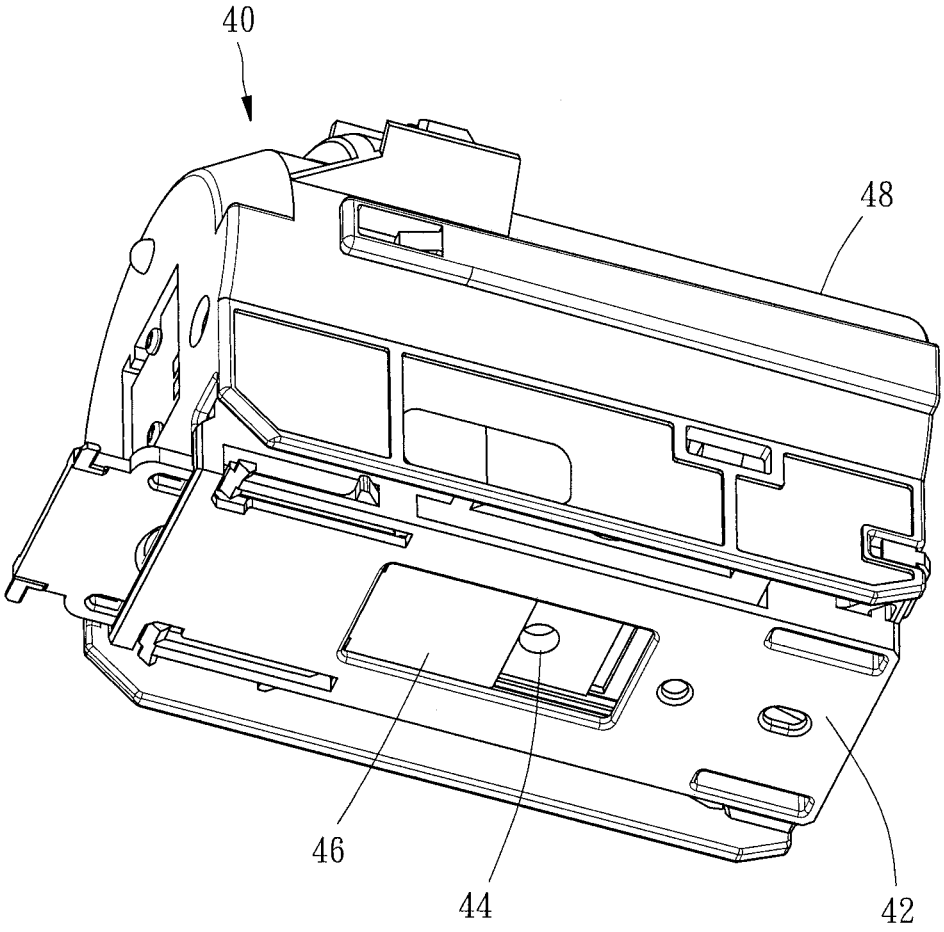
FIG. 5 is a perspective view of a powder storing cover according to the first preferred embodiment of the present invention.

As shown in FIG. 5, the powder storing cover 40 has a cover body 42 sleeved onto at least a part of the pipe portion 22 of the transmission member 20 to close the four outlets 28 of the transmission member 20, a powder exit 44 provided on the bottom side of the cover body 42 and located under the powder guiding member 30, a sliding piece 46 slidably disposed at the cover body 42 for opening or closing the powder exit 44, and an outer shell 48 covering parts of the cover body 42. The cover body 42 defines an internal space therein. The powder guiding member 30 is located in the internal space of the powder storing cover 40 and located above the powder exit 44. The aforesaid to close the four outlets 28 means that after the carbon powder passed through the outlets 28, it is temporarily kept in the internal space of the powder storing cover 40. The outer shell 48 of the powder storing cover 40 is fixed to the electronic imaging device and not going to rotate. When the sliding piece 46 slides to the left to open the powder exit 44, the toner cartridge 1 can discharge the carbon powder through the powder exit 44. When the sliding piece 46 slides to the right to close the powder exit 44, the carbon powder is preserved in the toner cartridge 1.

When the toner cartridge 1 is installed in the electronic imaging device and operates, the driving gear of the electronic imaging device drives the transmission member 20, the cylinder 10 and the powder guiding member 30 to rotate together, and the powder storing cover 40 is not rotated. During the rotation of the cylinder 10, the carbon powder located in the cylinder 10 is gradually moved to the opening 12 by the rotation of the thread 14. The carbon powder leaves the cylinder 10 through the opening 12, and then enters the internal space of the powder storing cover 40 through the outlets 28. The carbon powder located in the powder storing cover 40 is driven by the rotation of each blade 34 of the powder guiding member 30 to move to the powder exit 44 of the powder storing cover 40. As a result, the carbon powder can be continuously and regularly discharged by the toner cartridge 1 through the powder exit 44 to be used by the electronic imaging device. Compared with the conventional technology, the toner cartridge 1 is simpler in structure, thereby convenient and fast in assembly; besides, false actions such as the elements in the toner cartridge 1 being locked by each other will not happen to disable the toner cartridge 1 to discharge carbon powder successfully.

Figure 6:
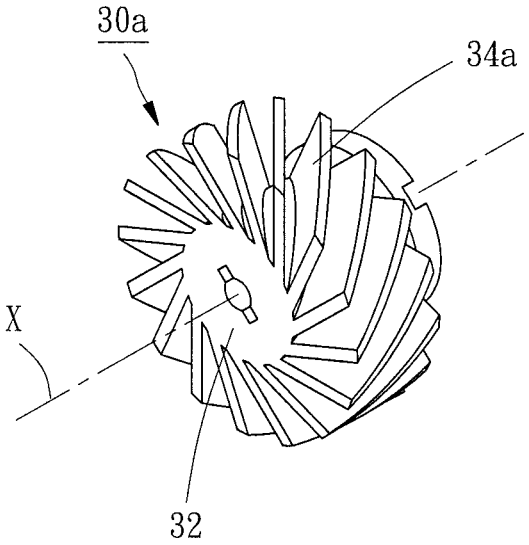
FIG. 6 is a perspective view of a powder guiding member according to a second preferred embodiment of the present invention.
Figure 7:
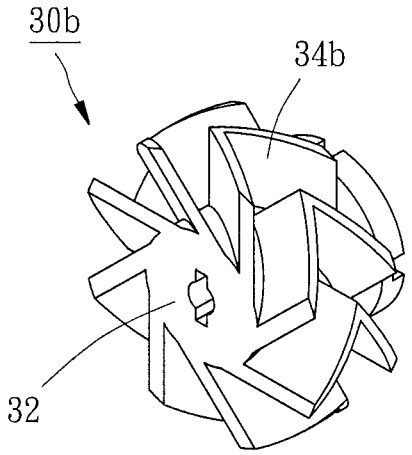
FIG. 7 is a perspective view of a powder guiding member according to a third preferred embodiment of the present invention.
Figure 8:
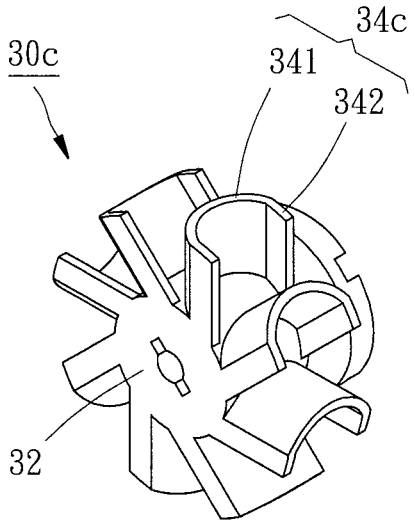
FIG. 8 is a perspective view of a powder guiding member according to a fourth preferred embodiment of the present invention.
Figure 9:
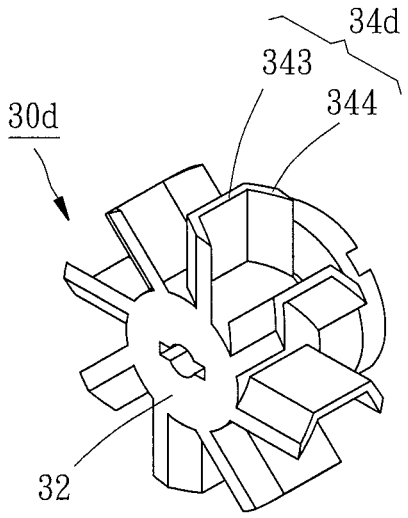
FIG. 9 is a perspective view of a powder guiding member according to a fifth preferred embodiment of the present invention.
Figure 10:
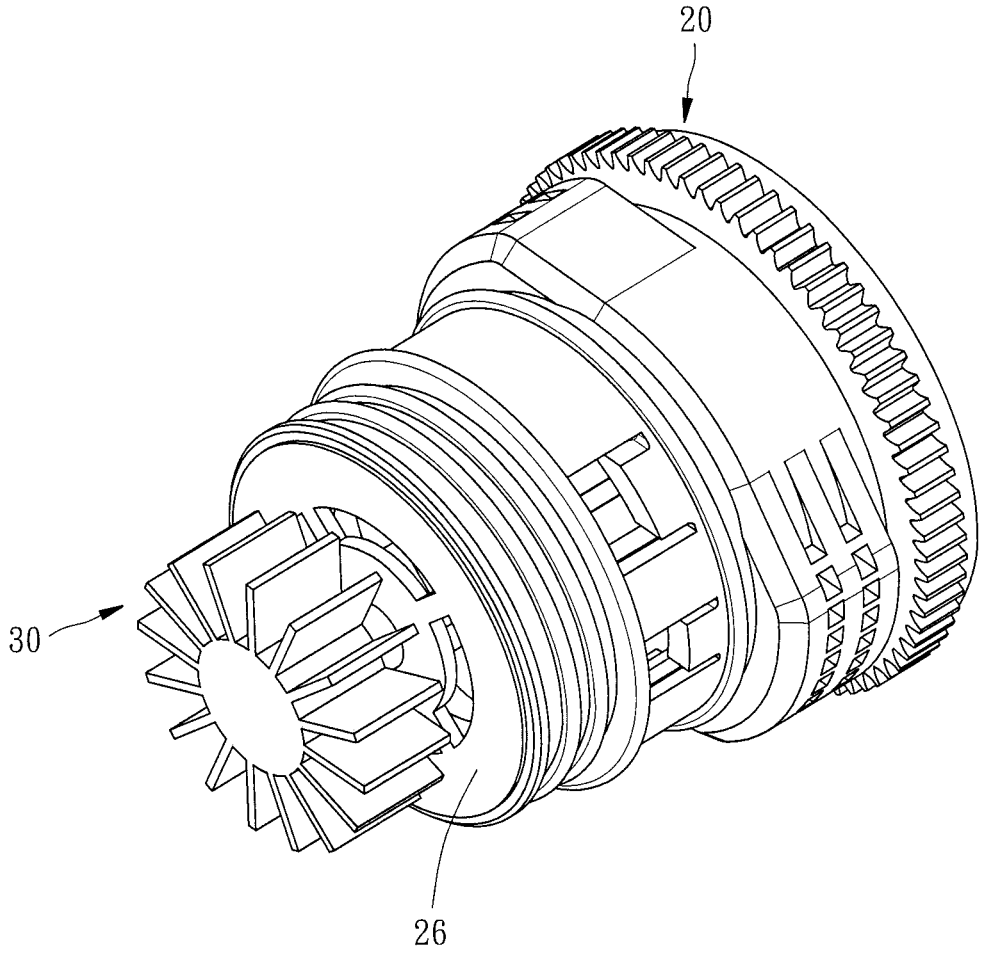
FIG. 10 is a perspective view of a powder guiding member and a transmission member according to a sixth preferred embodiment of the present invention.

Based on the spirit of the present invention, the structure of the toner cartridge 1 may be modified. For example, the transmission member 20 may not be fixed to the cylinder 10; the transmission member 20 may be connected with a powder delivering rod (not shown) located in the cylinder 10; when the transmission member 20 is driven to rotate, the powder delivering rod, which has spiral blades, can move the carbon powder located in the cylinder 10 to the opening 12. Besides, the powder guiding member 30 may be modified in the shape of the blades 34 or the structure depending on demands, as long as the blades 34 can push the carbon powder located in the powder storing cover 40 to the powder exit 44. For example, the blades 34 may be not parallel to the axial direction X of the main body 32 of the powder guiding member 30, such as each blade 34*a* of a powder guiding member 30*a* of a toner cartridge according to a second preferred embodiment of the present invention as shown in FIG. 6, which is shaped as a flat plate and defines a predetermined angle with the axial direction X of the main body 32 of the powder guiding member 30*a*, or such as each blade 34*b* of a powder guiding member 30*b* of a toner cartridge according to a third preferred embodiment of the present invention as shown in FIG. 7, which is V-shaped and rotatable along with the main body 32 with a V-shaped opening toward the powder exit 44. A powder guiding member 30*c* of a toner cartridge according to a fourth preferred embodiment of the present invention is shown in FIG. 8, each blade 34*c* of which has an arc-shaped base 341 and two side boards 342 extended from two sides of the arc-shaped base 341 respectively, so that each blade 34*c* is U-shaped and rotatable along with the main body 32 with an U-shaped opening toward the powder exit 44. A powder guiding member 30*d* of a toner cartridge according to a fifth preferred embodiment of the present invention is shown in FIG. 9, each blade 34*d* of which has a flat base 343 and two side boards 344 extended from two sides of the flat base 343 respectively and inclined outwardly, so that each blade 34*d* is approximately U-shaped and rotatable along with the main body 32 with an U-shaped opening toward the powder exit 44. In the first preferred embodiment, the powder guiding member 30 and the transmission member 20 are screwed together. In other embodiments, the powder guiding member 30 may be connected with the transmission member 20 in other ways, such as engaging or gluing, or even extended from the end portion 26 of the transmission member 20 integrally, as long as the powder guiding member 30 and the transmission member 20 are fixed to each other, thereby rotatable together, that may refer to the transmission member 20 and the powder guiding member 30 of a toner cartridge according to a sixth preferred embodiment of the present invention as shown in FIG. 10. In other embodiments, the main body 32 of the powder guiding member 30 may not be disposed at the center of the end portion 26 of the transmission member 20, but disposed at other positions of the end portion 26. However, the powder guiding member 30, whose main body 32 is disposed at the center of the end portion 26 of the transmission member 20, can push the carbon powder to the powder exit 44 relatively more evenly. The main body 32 of the powder guiding member 30 may have no such rod portion 325 so that the axle portion 321 is directly connected with the plate base 323. The main body 32 may have no such plate base 323 so that the rod portion 325 is directly connected with the end portion 26 of the transmission member 20. The main body 32 may even have no such rod portion 325 and plate base 323 at the same time so that the axle portion 321 is disposed at the end portion 26. The clutch portions 327 of the plate base 323 may not be abutted on the inner borders 281 of the outlets 28, or the plate base 323 may have no such clutch portions 327. However, the plate base 323 having the clutch portions 327 abutted on the inner borders 281 of the outlets 28 can make the powder guiding member 30 and the transmission member 20 combined more firmly.

Figure 11:
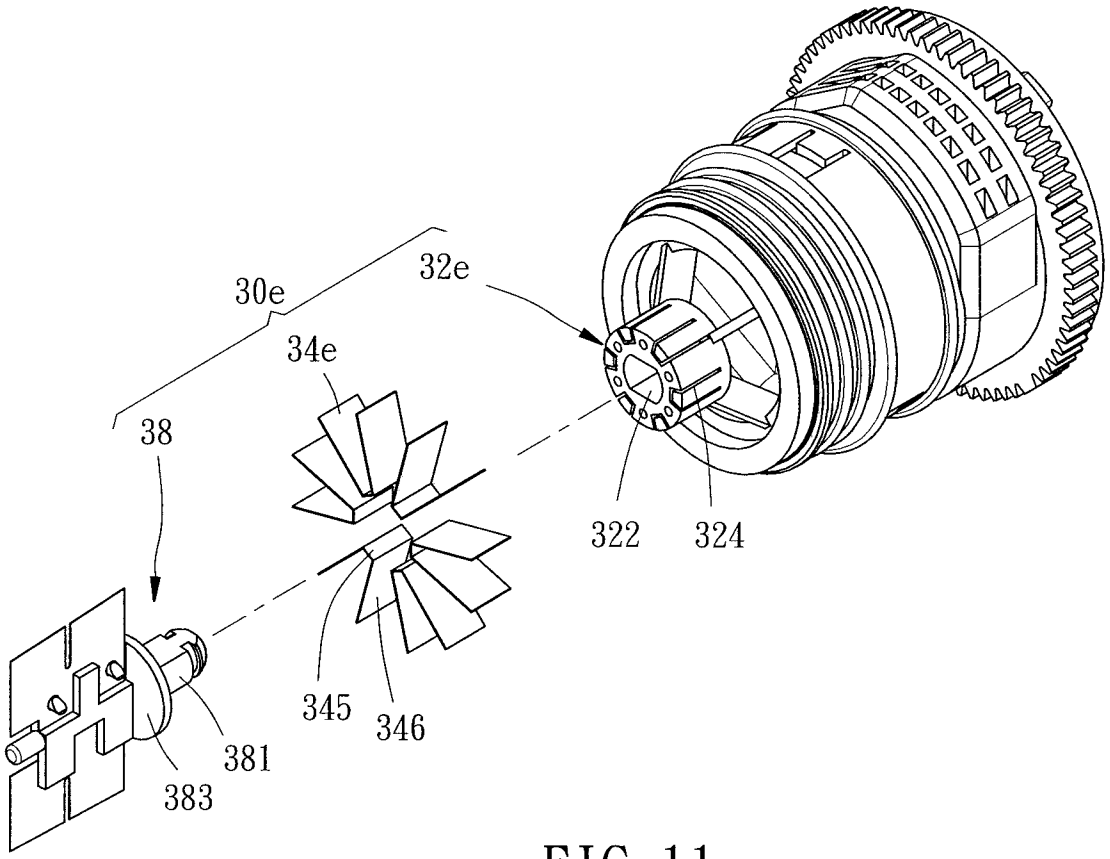
FIG. 11 is an exploded perspective view of parts of a seventh preferred embodiment of the present invention.
Figure 12:
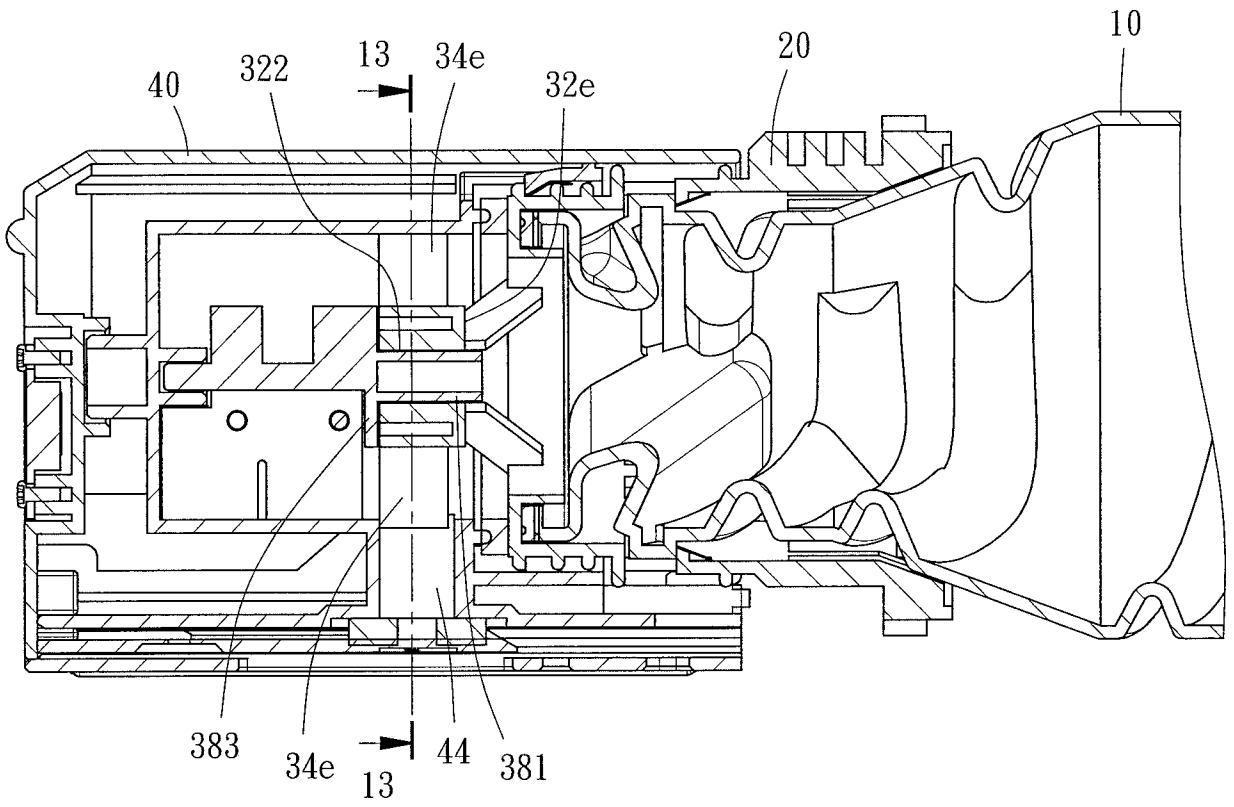
FIG. 12 is a sectional view of parts of the seventh preferred embodiment of the present invention.
Figure 13:
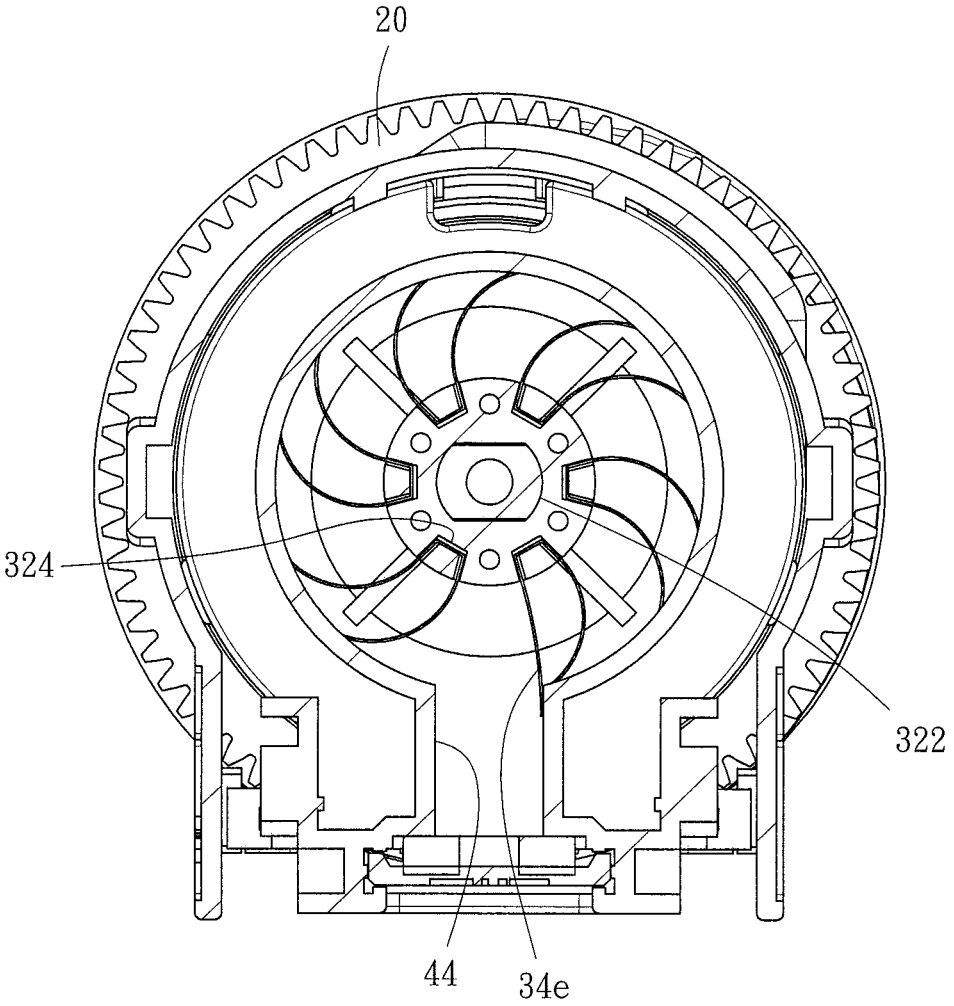
FIG. 13 is a sectional view taken along the line 13-13 in FIG. 12.

Furthermore, a toner cartridge according to a seventh preferred embodiment of the present invention is partially shown in FIGS. 11-13, wherein the blades 34*e* of the powder guiding member 30*e* are made of elastic material, and the free end of each blade 34*e* is abutted against the powder storing cover 40. In fact, the blades 34*e* are a little bended and elastically abutted against the inner wall of the powder storing cover 40. When one of the blades 34*e* is rotated to be above the powder exit 44 as shown in FIG. 13, the elasticity of the blade 34*e* is released so that the blade 34*e* is straightened and inserted in the powder exit 44. In this way, especially the remanent powder located on the inner wall of the powder storing cover 40 can be removed by the free ends of the blades 34*e* so as to be discharged through the powder exit 44, so that the amount of the remanent powder of the toner cartridge is lowered more effectively than that in the aforesaid embodiments. Besides, the powder guiding member 30*e* further has a plug member 38 having a rod portion 381 and a plate portion 383 provided at an end of the rod portion 381. The main body 32*e* of the powder guiding member 30*e* has an axial hole 322, and a plurality of embedding grooves 324 concaved from a free end of the main body 32*e*. The rod portion 381 of the plug member 38 is inserted in the axial hole 322, and the blades 34*e* are inserted in the embedding grooves 324. The cross sections of the axial hole 322 and the rod portion 381 are not circular, so the plug member 38 will not rotate relative to the main body 32*e*. The plate portion 383 of the plug member 38 is abutted on the free end of the main body 32*e* to prevent the blades 34*e* from escaping from the embedding grooves 324. In this embodiment, the embedding grooves 324 are U-shaped at the free end of the main body 32*e*, and each of the blades 34*e* has a U-shaped inserting portion 345 located in the embedding groove 324 and two wing portions 346 extended from two ends of the inserting portion 345. In this way, the blades 34*e* will not escape from the main body 32*e* along its radial direction. In other embodiments, the blades 34*e* and the embedding grooves 324 may be modified in shape depending on demands, as long as the blades 34*e* will not escape from the embedding grooves 324; for example, the blades 34*e* may be reverse-T-shaped and the embedding grooves 324 may be straight. The blades 34*e* may be fixed to the main body 32*e* of the powder guiding member 30*e* by means of other structures. The free ends of the blades 34*e* may not be abutted against the powder storing cover 40.

The above description represents merely the embodiments of the present invention, without any intention to limit the scope of the present invention. The simple structural variations and modifications not to be regarded as a departure from the spirit of the invention are intended to be included within the scope of the following claims.

What is claimed is:

1. A toner cartridge comprising:

a cylinder having an opening communicating with interior and exterior of the cylinder;

a transmission member having a pipe portion sleeved onto the cylinder, a gear ring provided on a periphery of the pipe portion, an end portion provided at a free end of the pipe portion, and at least one outlet provided at the end portion and communicating with the opening;

a powder guiding member having a main body fixed to the end portion of the transmission member, and a plurality of blades extended from the main body radially; and a powder storing cover having a cover body sleeved onto the pipe portion of the transmission member to close the outlet, and a powder exit provided on a bottom side of the cover body and located under the powder guiding member.

2. The toner cartridge as claimed in claim 1, wherein the main body of the powder guiding member is disposed at a center of the end portion of the transmission member.

3. The toner cartridge as claimed in claim 2, wherein the main body of the powder guiding member has a plate base abutted on the end portion of the transmission member and having at least one clutch portion inserted in said at least one outlet of the transmission member.

4. The toner cartridge as claimed in claim 3, wherein two lateral surfaces of the clutch portion are abutted on an inner border of the outlet.

5. The toner cartridge as claimed in claim 1, wherein the main body of the powder guiding member has a plate base abutted on the end portion of the transmission member and having at least one clutch portion inserted in said at least one outlet of the transmission member.

6. The toner cartridge as claimed in claim 5, wherein two lateral surfaces of the clutch portion are abutted on an inner border of the outlet.

7. The toner cartridge as claimed in claim 1, wherein the blades are shaped as flat plates.

8. The toner cartridge as claimed in claim 7, wherein the blades are parallel to an axial direction of the main body of the powder guiding member.

9. The toner cartridge as claimed in claim 7, wherein the blades are not parallel to an axial direction of the main body of the powder guiding member.

10. The toner cartridge as claimed in claim 1, wherein the blades are V-shaped or U-shaped.

11. The toner cartridge as claimed in claim 1, wherein the powder guiding member is integrally extended from the end portion of the transmission member.

12. The toner cartridge as claimed in claim 1, wherein the powder guiding member is disposed at the end portion of the transmission member by a screw.

13. The toner cartridge as claimed in claim 1, wherein the blades of the powder guiding member are made of elastic material.

14. The toner cartridge as claimed in claim 13, wherein free ends of the blades of the powder guiding member are abutted against the powder storing cover.

15. The toner cartridge as claimed in claim 14, wherein the blades of the powder guiding member are able to be inserted in the powder exit.

16. The toner cartridge as claimed in claim 13, wherein the powder guiding member further has a plug member having a rod portion and a plate portion provided at an end of the rod portion; the main body has an axial hole, and a plurality of embedding grooves concaved from a free end of the main body; the rod portion of the plug member is inserted in the axial hole, and the blades are inserted in the embedding grooves; the plate portion of the plug member is abutted on the free end of the main body to prevent the blades from escaping from the embedding grooves.

17. The toner cartridge as claimed in claim 16, wherein the embedding grooves are U-shaped at the free end of the main body; each of the blades has an inserting portion which is U-shaped and located in the embedding groove, and two wing portions extended from two ends of the inserting portion.

* * * * *